United States Patent [19]

Ishikawa et al.

[11] Patent Number: 5,014,465

[45] Date of Patent: May 14, 1991

[54] ADJUSTING DEVICE FOR USE IN WORK-WELL ATTACHMENT MOUNTED ON STILE

[75] Inventors: Masayoshi Ishikawa; Masami Takemura, both of Toyama, Japan

[73] Assignee: Yoshida Kogyo K. K., Tokyo, Japan

[21] Appl. No.: 415,729

[22] Filed: Oct. 2, 1989

[51] Int. Cl.[5] ..... E06B 7/16

[52] U.S. Cl. ..... 49/482; 49/417

[58] Field of Search ..... 49/417, 418, 468, 470, 49/482, 486, 488, 414, 415

[56] References Cited

U.S. PATENT DOCUMENTS

| | | | |
|---|---|---|---|
| 519,536 | 5/1894 | Koenemann | 49/414 |
| 1,525,002 | 2/1925 | Sembower | 49/414 X |
| 1,677,067 | 7/1928 | Zimmerman et al. | 49/482 X |
| 2,476,947 | 7/1949 | Schunk | 49/414 |
| 2,595,595 | 5/1952 | McKay | 49/418 |
| 3,374,580 | 3/1968 | Ruff | 49/482 |
| 3,453,780 | 7/1969 | Thompson | 49/482 |
| 3,626,639 | 12/1971 | Lucia | 49/417 |
| 3,854,246 | 12/1974 | McAllister | 49/482 X |
| 4,064,924 | 12/1977 | Catlett | 49/482 X |

*Primary Examiner*—Rodney M. Lindsey
*Assistant Examiner*—Jerry Redman
*Attorney, Agent, or Firm*—Hill, Van Santen, Steadman & Simpson

[57] ABSTRACT

An adjusting device for use in a work-well attachment mounted on a stile of a door body of a door unit has a plurality of resilient thrusting members mounted in a longitudinally extending engaging groove formed in the rear surface of the attachment, and fixing screws for adjustably mounting the attachment on a support wall formed on one end of the stile through the thrusting members interposed therebetween. After assembling the attachment with one end of the stile, the screws are inserted through holes formed in the attachment and holes formed in the thrusting member, respectively, and adjustably threaded through the support wall of the stile thereby adjustably fixing the attachment to the stile.

5 Claims, 4 Drawing Sheets

ADJUSTING DEVICE FOR USE IN WORK-WELL ATTACHMENT MOUNTED ON STILE

BACKGROUND OF THE INVENTION

1. Field of the Invention:

This invention relates to an adjusting device for use in a work-well attachment mounted on a stile of a door body of a door unit, a double sliding door unit, etc. or on an abutting member for the door body.

2. Description of the Prior Art:

As a prior art example, there is known an adjusting device of the kind specified wherein, as shown, for example, in FIG. 1, an abutting stile b of one of two door bodies, $A_1$ and $A_2$ located adjacent to each other has a recess c formed therein, a weather stripping material e having a pair of fins d, d formed integrally therewith is mounted in the recess c, and fixing means g are inserted from the side of the fins d, d of the weather stripping material e through the bottom wall f thereof and are threaded through a support wall h of the recess c so as to be fixedly secured thereto, the arrangement being made such that the length of projection of the weather stripping material may be adjusted as desired by changing the amount of threading of the fixing means through the support wall. (Refer to U.S. Pat. No. 4,320,161 for example).

The above-mentioned prior art example has been disadvantageous in that, since during opening and shutting operations of the door bodies $A_1$ and $A_2$ the loading caused by the contacts of the weather stripping material e with the abutting stile b is directly transmitted to the fixing means g for fixedly securing the weather stripping material, there is a fear of the fixing means g coming loose due to repeated opening and shutting operations of the door bodies, and if the fixing means g coming loose, then the assembled condition of the weather stripping material e becomes poor so that smooth opening and shutting operations of the door bodies cannot be achieved.

Further, in case of replacing the weather stripping material e which has deteriorated due to its use for a long time, it is required to detach all the plurality of fixing means g for fixedly securing the weather stripping material e, and then attach a new weather stripping material e by using the plurality of fixing means, thus necessitating a very troublesome replacement operation.

Still further, since the weather stripping material e made of a synthetic resin is engaged by the metallic fixing means g, the loading caused when opening and shutting of the door bodies $A_1$ and $A_2$ are made is concentrated on the portion of the weather stripping material e engaged with the fixing means g, so that when it is used for long years there is a fear of the bottom wall portion f of the weather stripping material e initiating crack due to a partial damage thereof.

SUMMARY OF THE INVENTION

The present invention has been made to overcome the above-mentioned points at issue of the prior art weather stripping structure, and has for its object to provide an adjusting device for use in a work-well attachment mounted on a stile of a door body of a door unit wherein even when repeated opening and shutting operations of the door are made no disorder or misalignment occurs in the work-well attachment, and in case of replacing the weather stripping material which has deteriorated due to its use for a long time, detaching of the deteriorated weather stripping material and attaching of a new one can be conducted simply and without any risk of damaging it.

To achieve the above-mentioned object, according to the first aspect of the present invention, there is provided an adjusting device for use in a work-well attachment mounted on a stile of a door body of a door unit comprising: a work-well attachment adapted to be mounted on one of the stiles of the door body so as to extend one end of thereof, said work-well attachment having a longitudinally extending engaging groove formed substantially in the central area of the rear surface thereof, a plurality of resilient thrusting members adapted to be mounted in said engaging groove formed in said work-well attachment, and a plurality of fixing means for mounting said work-well attachment on a longitudinally extending support wall formed on one end of said stile on one end of said stile through the intermediary of the thrusting members in such a manner that the distance and the degree of inclination therebetween may be adjusted freely.

According to the second aspect of the present invention, there is provided an adjusting device for use in a work-well attachment mounted on a stile of a door body of a door unit as set forth in the first aspect, characterized in that said fixing means comprise screws each adapted to be inserted, after the assembly of said work-well attachment with one end of said stile, from the side of the outer surface of the work-well attachment through each of holes formed in the attachment at a plurality of predetermined positions thereof, and through an elongated hole formed substantially in the central part of each of the plurality of thrusting members, and then threaded through the support wall of said stile to thereby fixedly secure the work well attachment to the stile.

According to the third aspect of the present invention, there is provided an adjusting device for use in a work-well attachment mounted on a stile of a door body of a door unit as set forth either in the first aspect or in the second aspect, characterized in that said work-well attachment has a longitudinally extending groove formed on one side of the outer surface thereof, within which a weather stripping material is mounted.

According to the fourth aspect of the present invention, there is provided an adjusting device for use in a work-well of a door body of a door unit as set forth either in the first aspect or in the second aspect, characterized in that each of said plurality of thrusting members is comprised of a first abutting piece formed at one end thereof and adapted to abut against a pair of hook members formed on the rear surface of said work-well attachment, a second abutting piece at the other end thereof and having a pair of engaging pieces formed by a punching operation so as to be fitted in the engaging groove formed in the rear surface of said work-well attachment, and a curved, resilient main portion formed integrally with and between the first and second abutting pieces.

The present invention has the following advantages resulting from having the arrangements described in the above-mentioned aspects.

The amount of projection of the work-well attachment can be adjusted as desired by a simple operation for varying the amount of threading of the fixing means.

The work-well attachment is always biased in a direction away from the stile by the thrusting members interposed between the attachment and the stile. Further, since in the condition that the leading end of each of the fixing means connecting the attachment and the stile is threaded into the stile the head portions of the fixing means are always biased by the thrusting members in a direction opposite to the leading end thereof so that there is no fear of the fixing means comping loose by the action of the loading transmitted thereto even in case repeated opening and shutting of door bodies of a door unit and a double sliding door unit are made. Accordingly, the weather stripping material can always be kept in a good assembled condition.

Further, since the fixing means are inserted through the holes formed in the thrusting members, even in case the resiliency of the thrusting members is lost, the thrusting members can be prevented from dropping.

Furthermore, since the arrangement described in the second aspect enables deteriorated weather stripping material to be replaced with a new one by a very simple operation, the replacmenet operation can be made rapidly and possible damage of the weather stripping material as mentioned in the explanation of the prior art example can be avoided.

The above and other objects, aspects and advantages of the present invention will become apparent to those skilled in the art by making reference to the following description and the accompanying drawings in which preferred embodiments incorporating the principles of the present invention are shown by way of example only.

DETAILED DESCRIPTION OF PREFERRED EMBODIMENTS

The present invention will now be described below by way of example only with reference to FIGS. 2 to 7 of the accompanying drawings.

Figure 1:
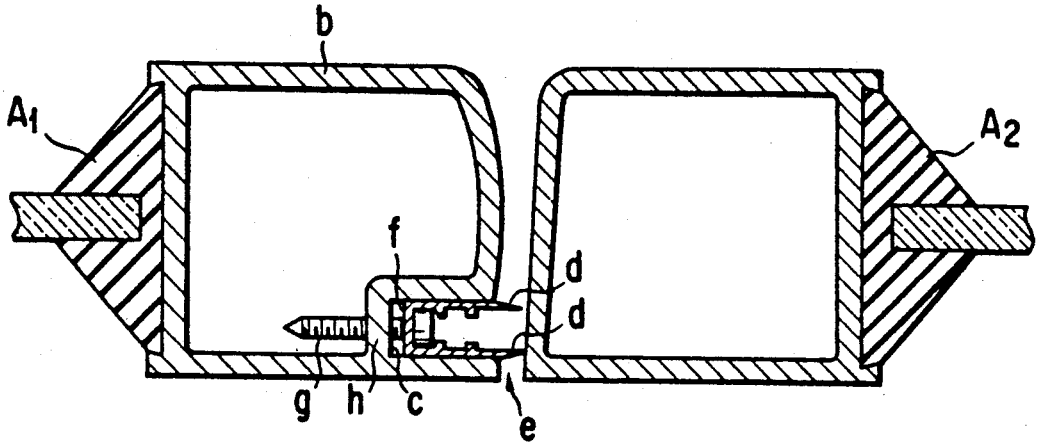
FIG. 1 PRIOR ART
FIG. 1 is a horizontal sectional view showing the principal parts of the prior art embodiment.
Figure 2:
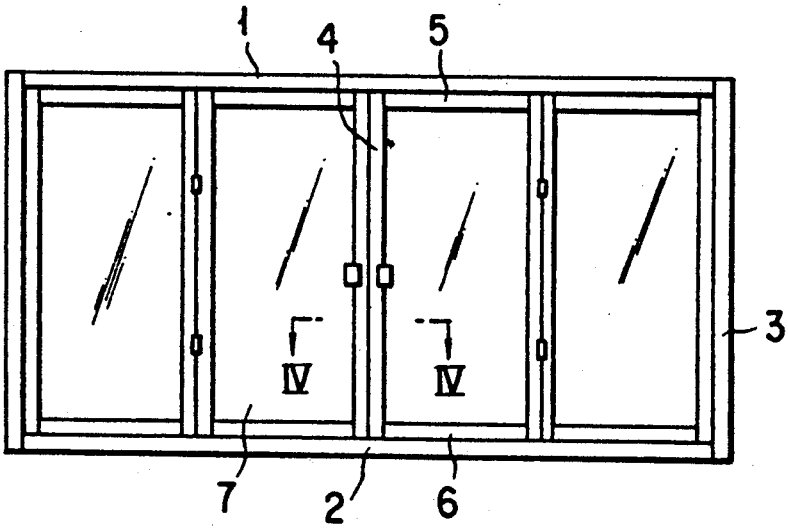
FIG. 2 is a front view of an entrance way of a building having double door closure components.
Figure 3A:
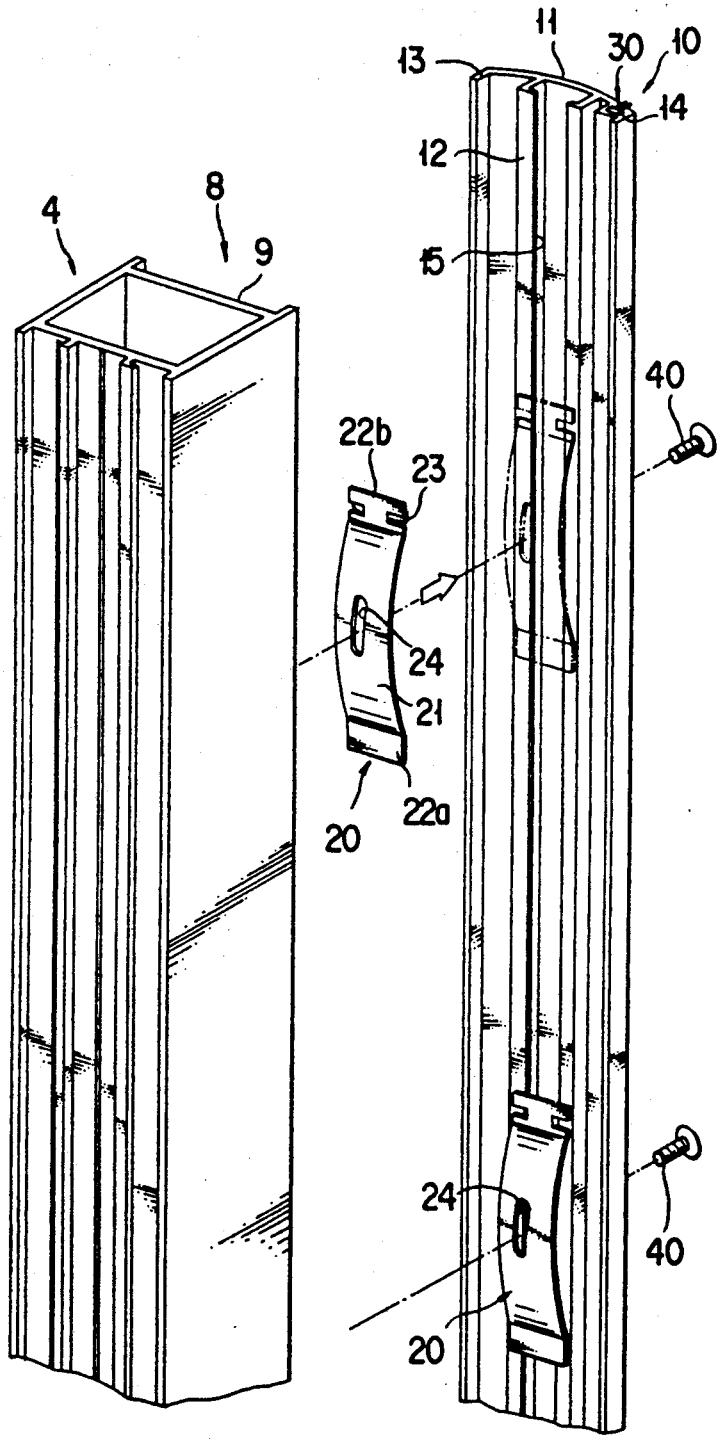
FIG. 3A is an exploded schematic perspective view showing the principal parts of an embodiment of the present invention.
Figure 3B:
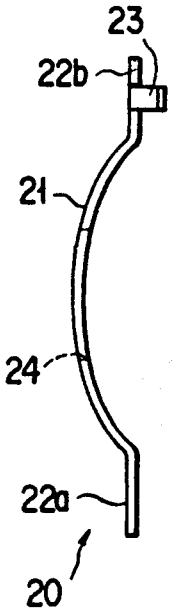
FIG. 3B is a side elevational view of a pressing member.
Figure 4:
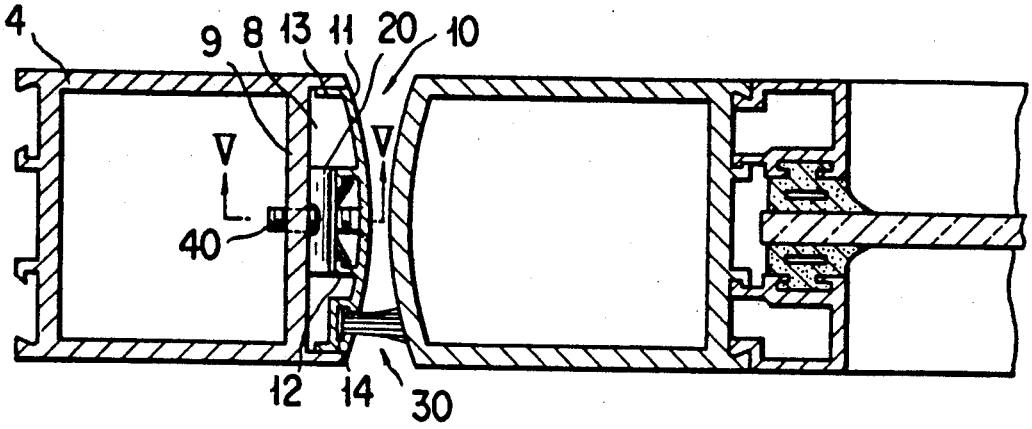
FIG. 4 is a sectional view taken along line IV—IV in FIG. 2.
Figure 5:
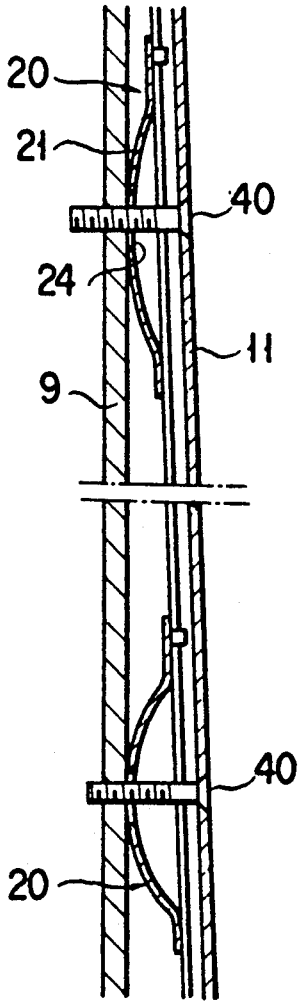
FIG. 5 is a fragmentary sectional view taken along V—V in FIG. 4.

FIG. 2 is an external appearance view showing an entrance way into a structure such as, for example, a building or the like. Its window framework is comprised of a rectangular member formed by an upper frame 1, a lower frame 2, and left and right vertical frames 3 and 3, in which a pair of door bodies are mounted in such a manner that they can be opened and shut freely.

Each door body is comprised of a rectangular stile-rail assembly formed by the left and right stiles 4, an upper rail 5 and a lower rail 6, all of which are made of aluminum extruded shapes, having a panel member 7 made of glass, for example, mounted therein.

A groove 8 formed in the stile 4 of one of the door bodies has, as shown in FIGS. 3A to 5, a long work-well attachment 10 made of an aluminum extruded shape (which will be referred to simply as "attachment" hereinbelow) mounted therein over the whole length thereof.

This attachment 10 is formed by a long, curved plate-shaped base plate 11, a pair of hook members 12, projecting from the central rear surface of the base plate 11, a pair of positioning members 13, projecting from both ends of the base plate 11, and a continuous, longitudinally extending groove 14 formed in the vicinity of one of the positioning members 13, so as to open in the opposite direction to the latter to mount a weather stripping material 30 therein, the pair of hook members 12, forming an engaging groove 15 for temporarily anchoring thrusting members 20, which will be mentioned later.

The above-mentioned thrusting member 20 is formed by a curved, resilient main portion 21 made of stainless steel, a first abutting piece **22*a* adapted to abut against the hook members 12, of the attachment 10, and a second abutting piece 22*b* having a pair of engaging pieces 23, formed by punching in the other end of the main portion 21. The main portion 21 has an insertion hole 24 formed substantially in the central part thereof, in which a fixing means 40**, that will be mentioned hereinbelow, is to be inserted.

Next, an assembly procedure for mounting the attachment 10 on the stile 4 will be described.

Figure 6:
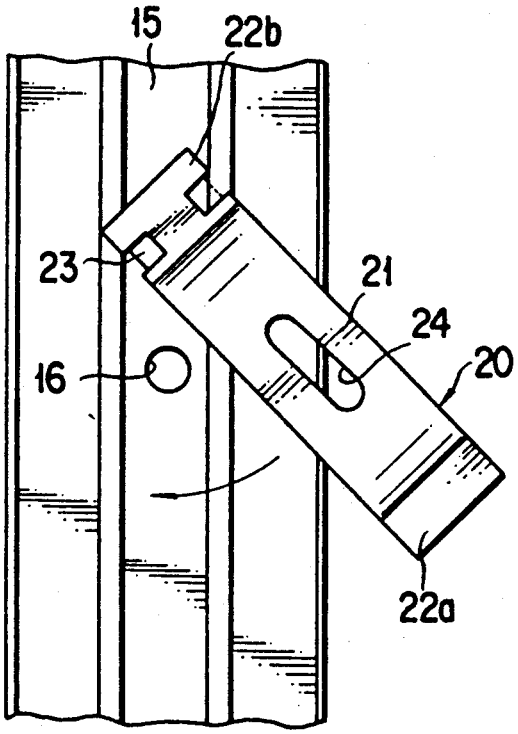
FIG. 6 is an explanatory view showing how to mount the pressing member on a work-well attachment.
Figure 7:
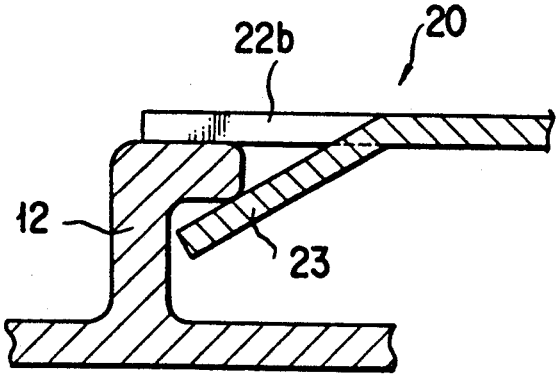
FIG. 7 is a fragmentary, horizontal sectional view showing the engagement between the above-mentioned work-well attachment and the above-mentioned thrusting member.

In the first place, as shown in FIG. 6, the pair of engaging pieces 23, of the thrusting member 20 are located within the engaging groove 15 in the attachment 10, and then the thrusting member 20 is turned in the direction shown by an arrow, thus engaging the pair of engaging pieces 23, of the thrusting member 20 with the pair of hook members 12, of the attachment 10 to thereby fixedly secure the pressing member 20 in the engaging groove 15 temporarily. Thereafter, the same operation is made repeatedly to temporarily fixedly secure a plurality of thrusting members 20, at predetermined positions on the attachment 10. Further, the attachment 10 has a plurality of through-holes 16 formed previously therein. The thrusting members 20 are temporarily fixedly secured to the attachment 10 with each of the through-holes 16 registered substantially with each of the insertion holes 24 formed in the thrusting members 20. Subsequently, the positioning members 13, formed on both sides or edges of the attachment 10 are fitted in the groove 8 in the stile 4, and then fixing means such as screws 40 are inserted from the outer surface of the attachment 10 through the insertion holes 24 formed in the thrusting members 20, and then the leading ends thereof are threaded into the support wall 9 of the stile 4 while the thrusting members 20, are being pushed. Thereafter, the same operation is made repeatedly to fixedly secure the attachment 10 to the stile 4.

In cases where the assembled condition of the door bodies is so poor that the weather stripping material 30 mounted on the attachment 10 is not allowed to abut against the stile 4 of the opposite door body, it is only necessary to adjust the fixing means 40 so as to reduce the amount of threading thereof. Further, in case the weather stripping material 30 is abutting against the stile 4 so much that smooth opening and shutting operation of the door cannot be made, it is only necessary to adjust the fixing means 40 to increase the amount of threading thereof.

Further, in putting the present invention into practical use, the attachment 10 may be applied to the upper and lower rails 5 and 6 of door bodies of a double sliding door unit so far as it is not against the gist of the present invention, and the insertion holes 24 formed in the thrusting members 20 are not to be limited to the elongated holes as shown, and instead they may be formed to have a diameter somewhat larger than that of the fixing means 40. Still further, the shapes and materials, etc. of the support wall 9, the attachment 10, the engaging groove 15 and the thrusting members 20, etc. are not to be limited to those of the above-mentioned embodiment, but various changes or modifications thereof may be made readily by those skilled in the art.

It is to be understood that the foregoing description is merely illustrative of preferred embodiments of the present invention, and that the scope of the invention is not to be limited thereto, but is to be determined by the scope of the appended claims.

What is claimed is:

1. An adjusting device for use in a work-well attachment mounted on a stile of a door body of a door unit, comprising: a work-well attachment adapted to be mounted on one of the stiles of the door body so as to extend longitudinally along one end thereof, said work-well attachment having a longitudinally extending engaging groove formed substantially in a central area of a rear surface thereof, a plurality of fixing means for mounting said work-well attachment on a longitudinally extending support wall formed on one end of said stile through an intermediary of each of a plurality of thrusting members in such a manner that the distance and the degree of inclination therebetween may be adjusted freely, wherein each of said plurality of thrusting members is comprised of a first abutting piece means, formed at one end of said thrusting members, for abutting against a pair of hook members formed on said rear surface of said work-well attachment, a second abutting piece formed at the other end thereof and having a pair of engaging pieces formed by a punching operation so as to be fitted in the engaging groove formed in said rear surface of said work-well attachment, and a curved, resilient main portion formed integrally with and between the first and second abutting pieces.

2. An adjusting device for use in a work-well attachment mounted on a stile of a door body of a door unit, as claimed in claim 1, characterized in that said fixing means comprise screws each adapted to be inserted, after the assembly of said work-well attachment with one end of said stile, from the side of an outer surface of the work-well attachment through each of holes formed in the attachment at a plurality of predetermined positions thereof, and through an elongated hole formed substantially in a central part of each of said plurality of thrusting members, and then threaded through the support wall of said stile to thereby fixedly secure the work-well attachment to the stile.

3. An adjusting device for use in a work-well attachment mounted on a stile of a door body of a door unit, as claimed in claim 1, characterized in that said work-well attachment has a longitudinally extending groove formed on one side of an outer surface thereof, within which a weather stripping material is mounted.

4. An adjusting device for use in a work-well attachment mounted on a stile of a door body of a door unit, comprising: a work-well attachment adapted to be mounted on one of the stiles of the door body so as to extend longitudinally along one end thereof, said work-well attachment having a longitudinally extending engaging groove formed substantially in a central area of a rear surface thereof, a plurality of fixing means for mounting said work-well attachment on a longitudinally extending support wall formed on one end of said stile through an intermediary of each of a plurality of thrusting members in such a manner that the distance and the degree of inclination therebetween may be adjusted freely, wherein said fixing means comprise screws each adapted to be inserted, after the assembly of said work-well attachment with one end of said stile, from the side of an outer surface of the work-well attachment through each of holes formed in the attachment at a plurality of predetermined positions thereof, and through an elongated hole formed substantially in a central part of each of said plurality of thrusting members, and then threaded through the support wall of said stile to thereby fixedly secure the work-well attachment to the stile, wherein each of said plurality of thrusting members is comprised of a first abutting piece means, formed on one end of said thrusting members, for abutting against a pair of hook members formed on said rear surface of said work-well attachment, a second abutting piece formed on the other end thereof and having a pair of engaging pieces formed by a punching operation so as to be fitted in the engaging groove formed in the rear surface of said work-well attachment, and a curved, resilient main portion formed integrally with and between the first and second abutting pieces.

5. An adjusting device for use in a work-well attachment mounted on a stile of a door body of a door unit, as claimed in claim 4, characterized in that said work-well attachment has a longitudinally extending groove formed on one side of said outer surface thereof, within which a weather stripping material is mounted.

* * * * *